US006807283B2

(12) United States Patent
Masuda et al.

(10) Patent No.: US 6,807,283 B2
(45) Date of Patent: Oct. 19, 2004

(54) ELECTROACOUSTIC TRANSDUCER

(75) Inventors: Mitsuhiro Masuda, Shizuoka (JP); Yoshiharu Oishi, Shizuoka (JP); Kazushi Suzuki, Shizuoka (JP); Harunobu Tsuchiya, Shizuoka (JP)

(73) Assignee: Star Micronics Co., Ltd., Shizuoka (JP)

( * ) Notice: Subject to any disclaimer, the term of this patent is extended or adjusted under 35 U.S.C. 154(b) by 0 days.

(21) Appl. No.: 10/282,082

(22) Filed: Oct. 29, 2002

(65) Prior Publication Data

US 2003/0086584 A1 May 8, 2003

(30) Foreign Application Priority Data

Nov. 6, 2001 (JP) ..... P.2001-341119

(51) Int. Cl.[7] ..... H04R 25/00
(52) U.S. Cl. ..... 381/417; 381/414
(58) Field of Search ..... 381/417, 396, 381/412, 414, 151, 150, FOR 163, 431, 419; 340/388.5, 391.1, 388.1, 388.4, 384.73

(56) References Cited

U.S. PATENT DOCUMENTS 4,147,899 A * 4/1979 Mori et al.
6,671,383 B2 * 12/2003 Usuki et al. ..... 381/396

FOREIGN PATENT DOCUMENTS

JP 3149412 B 6/1991
JP 2000-201397 A 7/2000

* cited by examiner

*Primary Examiner*—Sinh Tran
(74) *Attorney, Agent, or Firm*—Sughrue Mion, PLLC

(57) ABSTRACT

A core having a coil wound thereon is fixed to a base at the bottom. The base is fixed to a case made of synthetic resin by insert molding. A diaphragm is fixed to the case in circumference, and also a magnetic flux guide member is fixed to the case in circumference. Since the diaphragm and the magnetic flux guide member is commonly fixed to the case, no variation in the distance between the diaphragm and the magnetic flux guide member would occur for every product. Further, a gap L is formed between the magnet and the magnetic flux guide member, and an air hole is formed in the magnetic flux guide member. This improves the passage of air and reduces air dumper effect without modifying the magnet in shape.

6 Claims, 6 Drawing Sheets

ELECTROACOUSTIC TRANSDUCER

BACKGROUND OF THE INVENTION

1. Field of the Invention

The present invention relates to an electroacoustic transducer which is used for a mobile phone, etc.

2. Description of the Related Art

FIG. 6 is a sectional view of an electroacoustic transducer of prior art. A core 3 having a coil 2 wound thereon is fixed to a base 4 at the bottom. The base 4 is fixed to a case 5 made of synthetic resin. A diaphragm 6 is disposed in the case 5 and a cover 7 is laid over the case 5. An annular magnet 8 is disposed around the coil 2 and fixed to the base 4. A magnetic flux guide member 9 made of magnetic material is disposed between the magnet 8 and the diaphragm 6. The magnetic flux guide member 9 reduces magneto-resistance of magnetic flux running through the magnet 8, the magnetic flux guide member 9, the diaphragm 6, the core 3, and the base 4, thus increasing electromagnetic force for driving the diaphragm 6. Such magnetic flux guide member is disclosed in a prior art such as JP-B-3149412. In the prior art, the diaphragm 6 is supported by the case 5, and the magnetic flux guide member 9 is directly fixed on the top of the magnet 8 by adhesive. As an alternative, the magnetic flux guide member 9 is fixed to the magnet 8 by insert molding.

To prevent a variation in sound characteristics of every product, it is highly important to strictly control the distance g1 between the magnetic flux guide member 9 and the diaphragm 6 in a state of unenergization of the coil 2. In the prior art, however, the magnetic flux guide member 9 is fixed to the magnet 8 while the diaphragm 6 is supported by the case 5. The distance g1 is therefore influenced by the height of the magnet 8 and also the height of a diaphragm supporting portion of the case 5. Thus, a strict control of the distance g1 is hardly available due to accumulation of dimensional tolerance of the magnet 8 and the case 5.

Further, when adhesive is used as in the prior art, the amount of adhesive needs to be maintained constant since it otherwise directly affects the distance g1. Generally, a magnet having higher energy product BHmax such as a sintered magnet is used in an electroacoustic transducer of this kind in order to secure enough amount of magnetic flux in a state of unenergization of the coil 2. The sintered magnet, however, inevitably requires a post process such as grinding to obtain dimensional accuracy of the magnet 8. When adhesive is used to fix the magnetic flux guide member 9 to the top of the magnet 8, the manufacturing process requires the adhering process, the strict amount control of adhesive, and the post process for the magnet. This increases the cost.

When insert molding is adopted as in the prior art, the magnetic flux guide member 9 is precisely positioned with respect to the magnet 8 by a mold. The distance g1 is therefore maintained with accuracy without a troublesome manufacturing process. The magnet 8, however, must be made of injection molding material for the purpose of insert molding. A plastic magnet is typically used though it has a lower energy product BHmax than the sintered magnet. Then the magnet volume needs be increased to secure enough amount of magnetic flux.

As the magnet volume is increased, the back space of the diaphragm 6 is reduced, affecting the operation of the diaphragm 6 by air dumper effect to lower the sound pressure level. If the back space of the diaphragm 6 is maintained, the overall dimensions of the electroacoustic transducer is inevitably increased. Further, insert molding is a costly alternative since it requires a dedicated equipment and then increases a price of a component.

Since the magnetic flux guide member 9 is located immediately below the diaphragm 6, it blocks the passage of air when the diaphragm 6 is operated in a state of energization of the coil 2. It adversely affects the operation of the diaphragm 6 by air dumper effect to lower the sound pressure level. A through-hole may be formed in the magnetic flux guide member 9 to communicate a space 12 formed between the diaphragm 6 and the magnetic flux guide member 9 with a space 11 formed inside the magnet 8. In the prior art, however, the magnetic flux guide member 9 is directly fixed on the top of the magnet 8, the magnet 8 also needs to have a notch or an opening formed corresponding to the through-hole formed in the magnetic flux guide member 9. Such irregular shape of the magnet 8 would prevent an even flow of magnetic flux to the diaphragm 6; thus possibly causing an abnormal operation of the diaphragm 6. Further, the sintered magnet or a magnet having higher energy product BHmax is difficult to be shaped to have a notch or an opening.

SUMMARY OF THE INVENTION

An object of the present invention is to provide a downsized and low-cost electroacoustic transducer having higher reliability eliminating a variation in sound characteristics for every product.

The present invention relates to an electroacoustic transducer comprising:

- a base;
- a core fixed upright on the base;
- a magnet disposed around the core;
- a diaphragm supporting member made of non-magnetic material and disposed around the magnet;
- a diaphragm supported on the diaphragm supporting member; and
- a magnetic flux guide member made of magnetic material, disposed between the magnet and the diaphragm, and fixed to the diaphragm supporting member.

According to the present invention, the diaphragm supporting member commonly has the diaphragm and the magnetic flux guide member fixed thereon. Since the diaphragm and the magnetic flux guide member are supported on the common member, the distance between the diaphragm and the magnetic flux guide member in a state of unenergization of a coil is easily controlled to a predetermined value with accuracy. Therefore, a variation in sound characteristics for every product is prevented and product reliability is improved. Since the magnet is free from the magnetic flux guide member, a magnet having higher energy product BHmax is available to secure enough magnetic flux at low cost.

Further, in the electroacoustic transducer of the present invention, the diaphragm supporting member has a projection and the magnetic flux guide member has an opening or a notch. The magnetic flux guide member is positioned with respect to the diaphragm supporting member by engagement of the opening or a notch with the projection. The magnetic flux guide member is fixed to the diaphragm supporting member by plastic deformation of the projection.

According to the invention, the magnetic flux guide member is restricted in position on the diaphragm supporting member. This structure easily achieves positioning accuracy of the magnetic flux guide member with respect to the diaphragm supporting member. Further, since the projection of the diaphragm supporting member is subject to plastic deformation, fixing strength by mechanical connection is so enough that no diaplacement or dropout of the magnetic flux guide member due to external shock would occur.

Further, in the electroacoustic transducer of the present invention, a gap for the passage of air is formed between the magnet and the magnetic flux guide member, and the magnetic flux guide member has an opening or a notch for the passage of air.

Since such gap for the passage of air is formed between the magnet and the magnetic flux guide member, air dumper effect is reduced without modifying the magnet in shape, thus preventing an abnormal operation of the magnet and improving product quality.

DETAILED DESCRIPTION OF THE INVENTION

Figure 1:
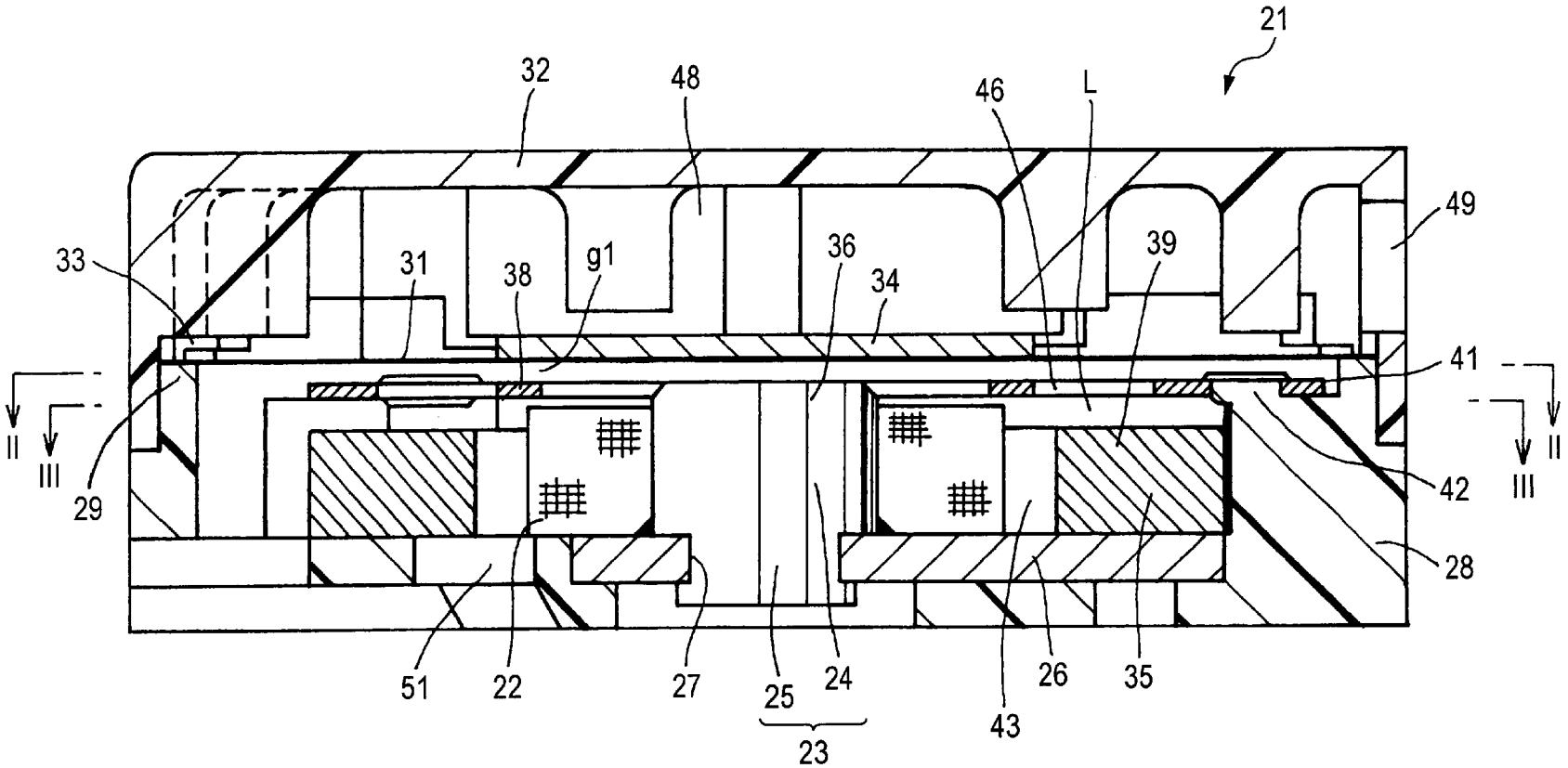
FIG. 1 is a sectional view of an electroacoustic transducer of an embodiment of the present invention.
Figure 2:
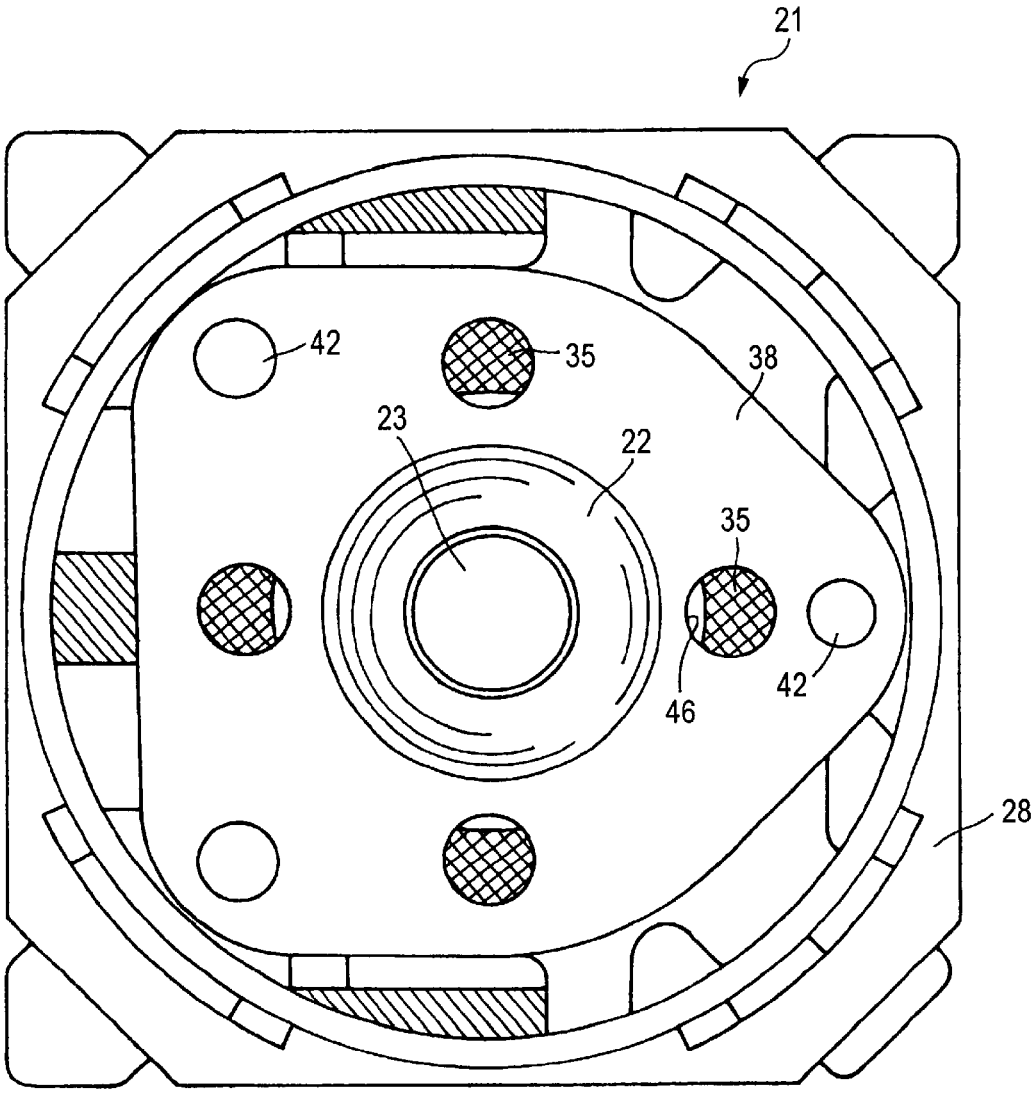
FIG. 2 is a sectional view seen from the II—II line in FIG. 1.
Figure 3:
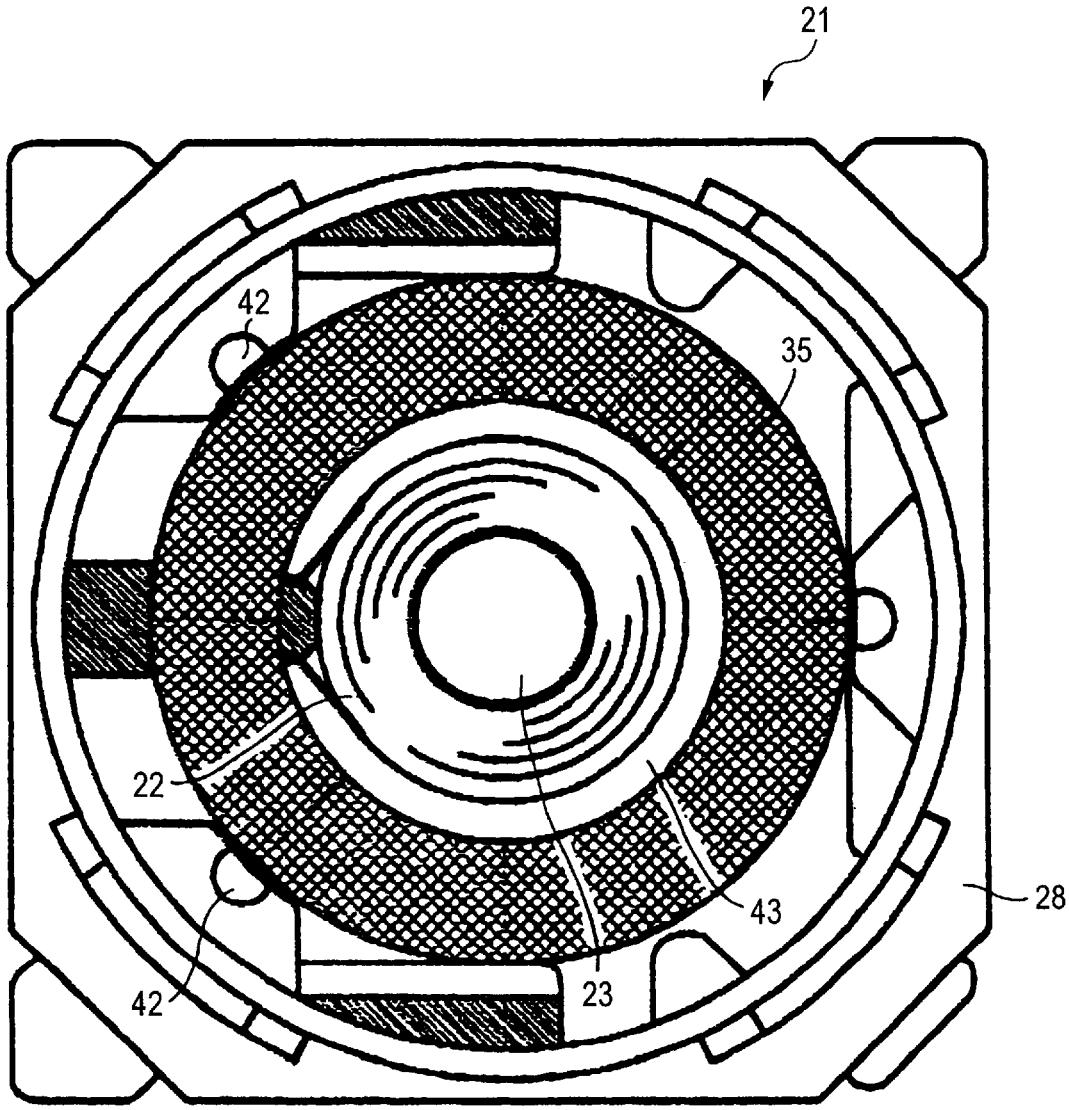
FIG. 3 is a sectional view seen from the III—III line in FIG. 1.

FIG. 1 is a sectional view of an electroacoustic transducer 21 of an embodiment of the present invention. FIG. 2 is a sectional view seen from the II—II line in FIG. 1. FIG. 3 is a sectional view seen from the III—III line in FIG. 1. A coil 22 is wound on a core body 24 of a core 23. A fixing portion 25 of the core 23, which is the bottom portion continued from the core body 24, penetrates through a caulking hole 27 formed in a base 26 to be caulked thereto. The base 26 made of ferromagnetic material is fixed to a case 28 made of synthetic resin by insert molding. The case 28 has a diaphragm supporting portion 29 where a diaphragm 31 is mounted in circumference. A cover 32 is fixed to the case 28. The diaphragm 31 may be made of ferromagnetic material, and a mass 34 made by ferromagnetic material may be added on the diaphragm 31 as shown in the embodiment. A magnet 35 is fixed to the base 26 so as to surround the coil 22 with a space reserved therefrom. The magnet 35 is annular in shape and concentric to the core 23. The magnet 35 is, for example, made of neodymium-based magnetic powder by compression molding. The diaphragm 31 is opposed to a free end 36 of the core body 24.

The case 28 is, for example, made of thermoplastic synthetic resin such as LCP resin. A magnetic flux guide member 38 made of ferromagnetic material is disposed between a top 39 of the magnet 35 and the diaphragm 31. The magnetic flux guide member 38 is rigid and, for example, made of Permalloy, having the shape of a flat plate. The magnetic flux guide member 38 has a circumference 41 having a mounting hole to be engaged with a mounting projection 42 formed in the case 28. The magnetic flux guide member 38 is fixed to the case 28 by engagement of the mounting hole with the mounting projection. As described above, the diaphragm 31 is supported in circumference on the diaphragm supporting portion 29 of the case 28 while the magnetic flux guide member 38 is fixed to the case 28 via the circumference 41. The distance g1 between the diaphragm 31 and the magnetic flux guide member 38 in a state of unenergization of the coil 22 is therefore precisely set, thereby preventing a variation in the distance g1 for every product. This prevents a variation in resonance frequency generated when the coil 22 is energized, thus improving the product quality.

Figure 4:
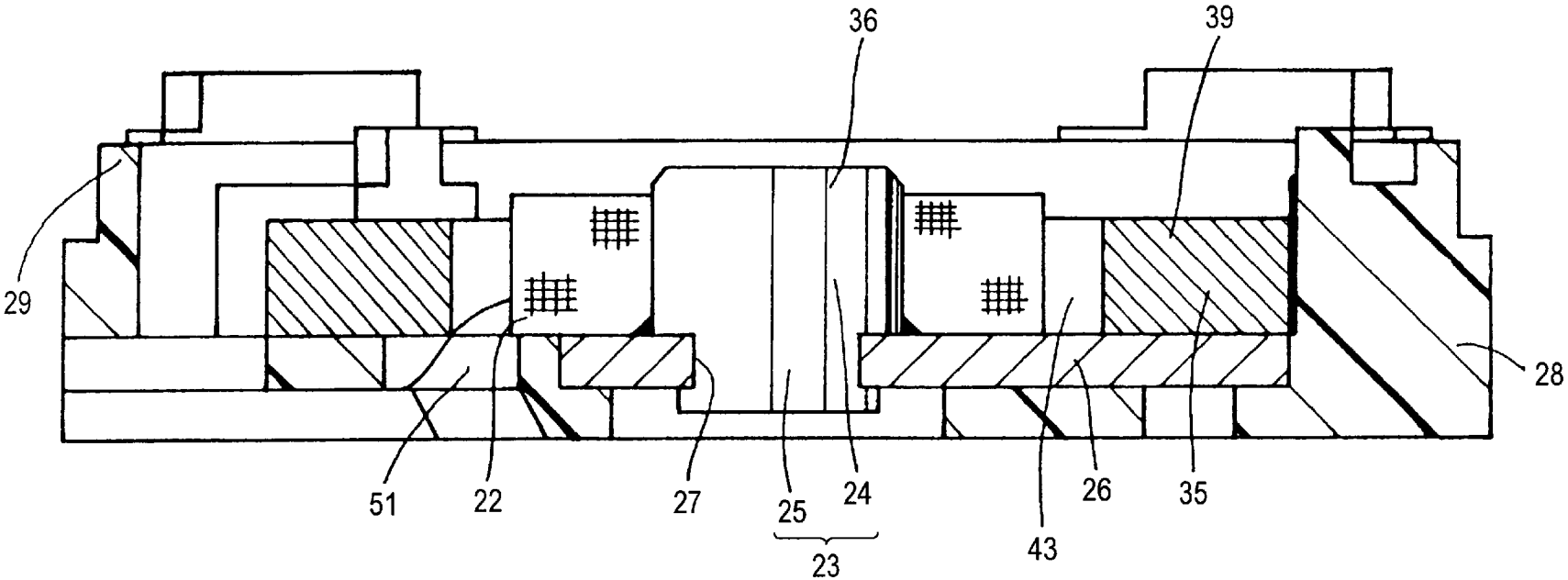
FIG. 4 is a sectional view of the electroacoustic transducer with the cover and the diaphragm removed.

A fixing structure of the magnetic flux guide member 38 and the case 28 is being described below. FIG. 4 is a sectional view of the electroacoustic transducer 21 with the cover 32 and the diaphragm 31 removed. The mounting projection 42 is integrally formed with the case 28 on the top thereof. In this embodiment, a plurality of the mounting projection 42 (three projections) is circumferentially formed with an interval reserved therebetween. The magnetic flux guide member 38 has mounting holes in respective positions corresponding to the mounting projections 42. The magnetic flux guide member 38 is placed on the case 28 with the mounting holes of the magnetic flux guide member 38 positioned with respect to the mounting projections 42. By engagement of the mounting hole with the mounting projection 42, the magnetic flux guide member 38 is restricted in position on the top of the case 28. No jig is required for positioning and no displacement would occur. Positioning accuracy is easily improved with the structure of the invention.

The mounting projection 42 has a height exceeding the thickness of the magnetic flux guide member 38. The free end of the mounting projection 42 is protruded on the magnetic flux guide member 38 when it is placed on the case 28. The protruded portion is, for example, pressed by a pressing machine to be deformed for fixation. Since the magnetic flux guide member 38 is mechanically fixed to the case 28 with higher fixing strength, displacement or dropout due to external shock is surely prevented.

A space 43 surrounded by the magnet 35 allows air flow via a gap L between the top 39 of the magnet 35 and the magnetic flux guide member 38. The magnetic flux guide member 38 has an air hole 46 formed therein. The air hole 46 faces the gap L and communicates with the space 43. A plurality of the air hole 46 is circumferentially formed around the axis of the core 23 with an interval reserved therebetween. A front space 48 of the diaphragm 31 surrounded by the cover 32 communicates with air via a communicating hole 49. The space 43 communicates with air via a communicating hole 51 formed in the case 28. This structure prevents an effect of air to the operation of the diaphragm 31. Air flow is improved since the gap L is reserved between the top 39 of the magnet 35 and the magnetic flux guide member 38, and the air hole 46 is formed in the magnetic flux guide member 38. An air dumber effect is reduced without modifying the shape of the magnet 35.

Figure 5:
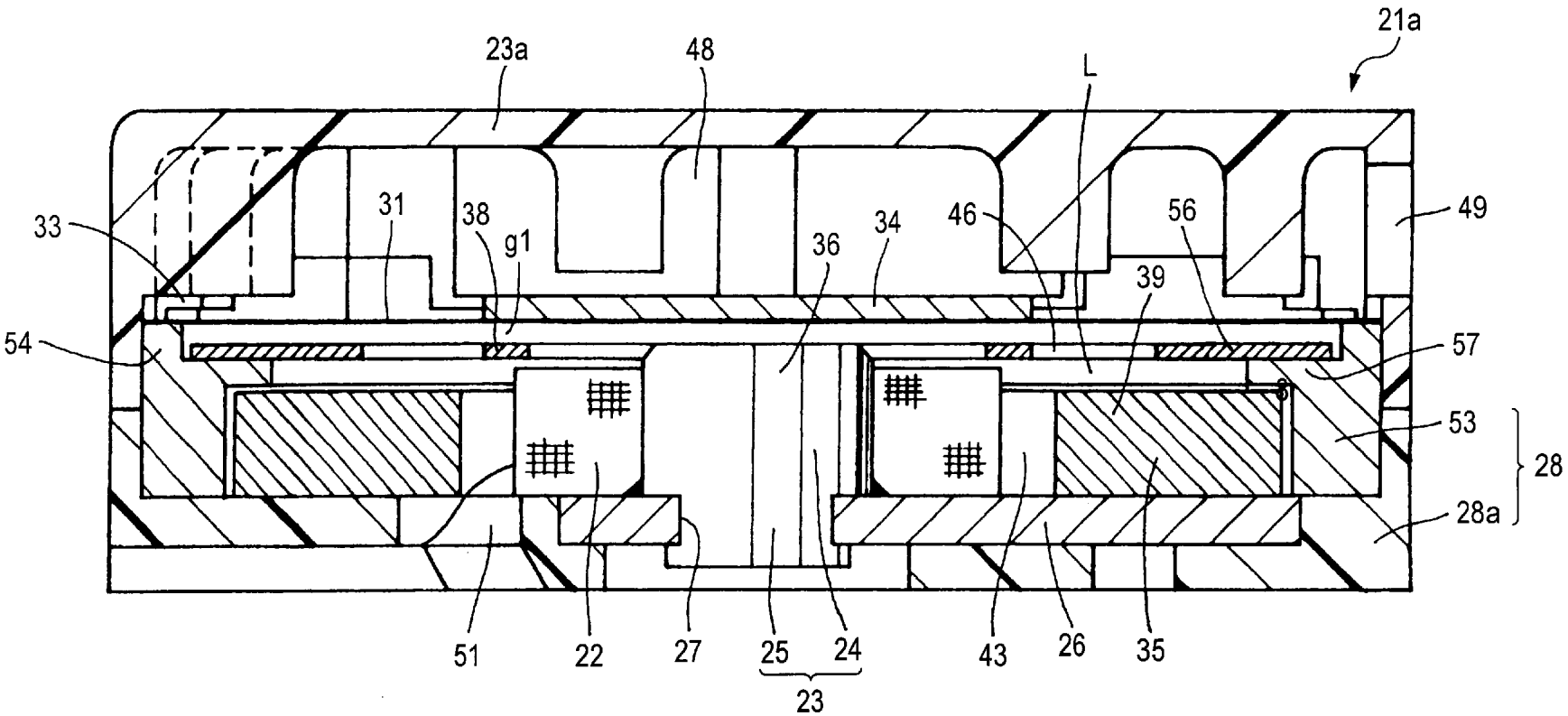
FIG. 5 is a sectional view of an electroacoustic transducer of another embodiment of the present invention.
Figure 6:
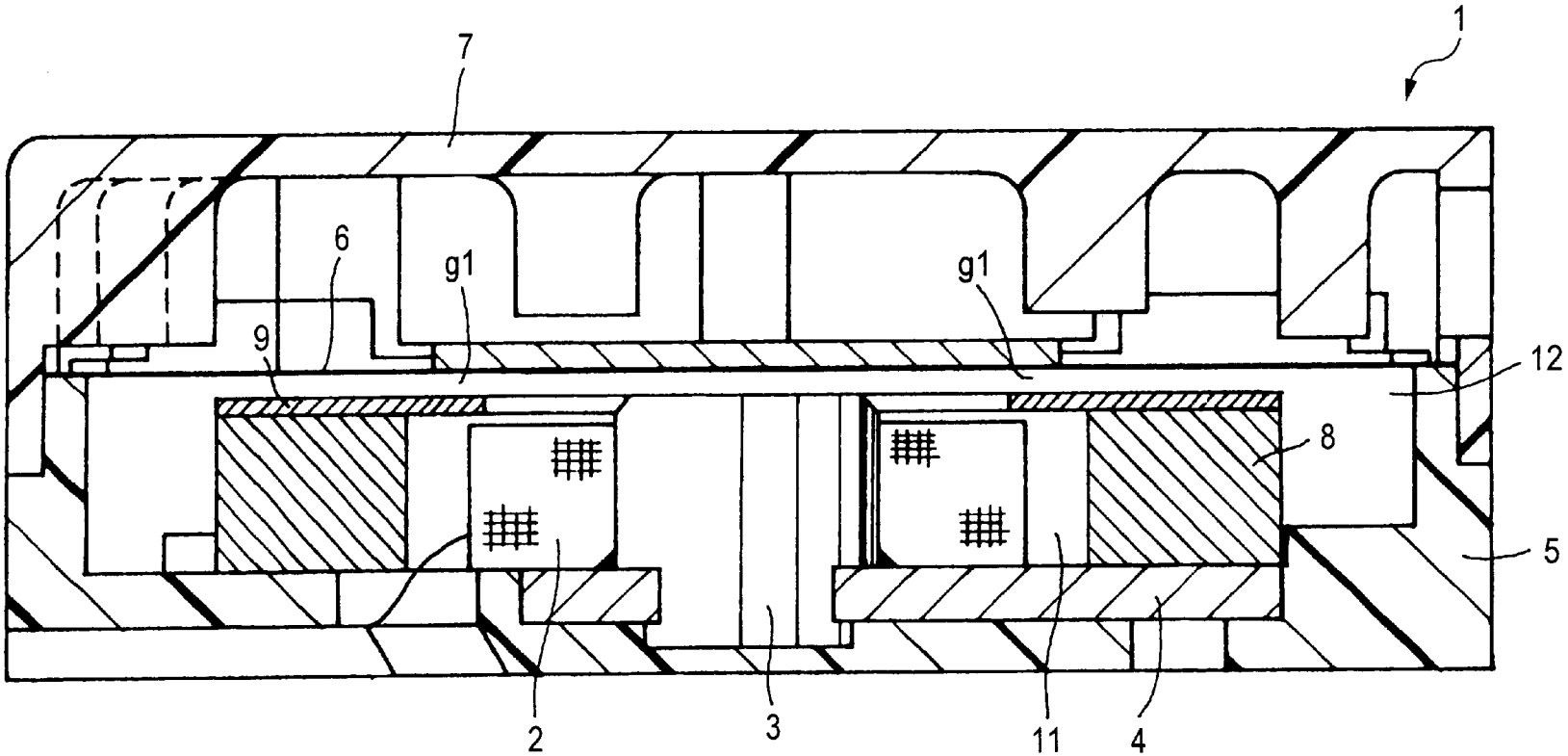
FIG. 6 is a sectional view of an electroacoustic transducer of prior art.

FIG. 5 is a sectional view of an electroacoustic transducer 21*a* of another embodiment. Since the structure is similar to the embodiment shown in FIGS. 1 to 4, the reference numbers are common for the same members. In this embodiment, the base 26 is fixed to a case body 28*a*, and a supporting member 53 as a diaphragm supporting member is fixed to the case body 28*a*. The supporting member 53 has a diaphragm supporting portion 54 where the diaphragm 31 is mounted in circumference. The magnetic flux guide member 38 has a circumference 56 which is supported by a shoulder 57 of the supporting member 53 and fixed thereto by, for example, welding. The supporting member 53 commonly supports the diaphragm 31 in circumference and the magnetic flux guide member 38 via the circumference 56. A variation in the distance g1 between the diaphragm 31 and the magnetic flux guide member 38 is prevented and therefore a variation in resonance frequency is prevented for every product, thus improving product quality. The gap L is formed between the top 39 of the magnet 35 and the magnetic flux guide member 38, and the air hole 46 is formed similarly to the first embodiment.

According to the invention, since the diaphragm supporting member commonly has the diaphragm and the magnetic flux guide member fixed thereon, the distance between the diaphragm and the magnetic flux guide member in a state of unenergization of a coil is easily controlled to a predetermined value with accuracy. Therefore, a variation in sound characteristics for every product is prevented and product reliability is improved. Since the magnet is free from the magnetic flux guide member, a magnet having higher energy product BHmax is available to secure enough magnetic flux at low cost.

According to the invention, the magnetic flux guide member is restricted in position on the diaphragm supporting member by engagement of the opening formed in the magnetic flux guide member with the projection formed in the diaphragm supporting member. This structure easily achieves positioning accuracy of the magnetic flux guide member with respect to the diaphragm supporting member. Further, since the projection of the diaphragm supporting member is subject to plastic deformation, fixing strength by mechanical connection is so enough that no diaplacement or dropout of the magnetic flux guide member due to external shock would occur.

According to the invension, since a gap for the passage of air is formed between the magnet and the magnetic flux guide member, air dumper effect is reduced without modifying the magnet in shape, thus preventing an abnormal operation of the magnet and improving product quality.

What is claimed is:

1. An electroacoustic transducer comprising:

a base;

a core fixed upright on the base;

a magnet disposed around the core;

a diaphragm supporting member made of non-magnetic material and disposed around the magnet;

a diaphragm having a ferromagnetic portion and being supported on the diaphragm supporting member; and a magnetic flux guide member made of magnetic material, disposed above the magnet and beneath the diaphragm so that magnetic flux guide member is disposed between the magnet and the diaphragm, wherein said magnetic flux guide member is fixed directly and mechanically on an upper surface of the diaphragm supporting member.

2. An electroacoustic transducer comprising:

a base;

a core fixed upright on the base;

a magnet disposed around the core;

a diaphragm supporting member made of non-magnetic material and disposed around the magnet;

a diaphragm supported on the diaphragm supporting member; and a magnetic flux guide member made of magnetic material, disposed between the magnet and the diaphragm and fixed on the diaphragm supporting member;

wherein the diaphragm supporting member has a projection and the magnetic flux guide member has an opening or a notch, and the magnetic flux guide member is positioned with respect to the diaphragm supporting member by engagement of the opening or the notch with the projection, and the magnetic flux guide member is fixed to the diaphragm supporting member by plastic deformation of the projection.

3. The electroacoustic transducer according to claim 1, wherein the magnetic flux guide member is fixed to the diaphragm supporting member without contacting the magnet so that a gap is formed between an upper surface of the magnet and a lower surface of the magnetic flux guide member.

4. An electroacoustic transducer comprising:

a base;

a core fixed upright on the base;

a magnet disposed around the core;

a diaphragm supporting member made of non-magnetic material and disposed around the magnet;

a diaphragm supported on the diaphragm supporting member; and a magnetic flux guide member made of magnetic material, disposed between the magnet and the diaphragm and fixed on the diaphragm supporting member, wherein a gap for the passage of air is formed between an upper surface of the magnet and a lower surface of the magnetic flux guide member so that the magnetic flux guide member is in non-contact with magnet, and the magnetic flux guide member has an opening for the passage of air.

5. The electroacoustic transducer according to claim 3, wherein magnetic flux guide member has a plurality of openings for the passage of air.

6. The electroacoustic transducer according to claim 3, wherein the opening is formed at a position corresponding to at least an upper surface of the magnet.

* * * * *